US006778161B2

(12) United States Patent
Chen et al.

(10) Patent No.: US 6,778,161 B2
(45) Date of Patent: Aug. 17, 2004

(54) CENTRAL SYMMETRIC GAMMA VOLTAGE CORRECTION CIRCUIT

(75) Inventors: Ming-Daw Chen, Taipei (TW); Yuhren Shen, TaiNan (TW)

(73) Assignee: Industrial Technology Research Institute, Hsinchu (TW)

( * ) Notice: Subject to any disclaimer, the term of this patent is extended or adjusted under 35 U.S.C. 154(b) by 111 days.

(21) Appl. No.: 09/842,817

(22) Filed: Apr. 27, 2001

(65) Prior Publication Data

US 2002/0158862 A1 Oct. 31, 2002

(51) Int. Cl.[7] ..... G09G 3/36

(52) U.S. Cl. ..... 345/89; 345/204; 348/674; 348/675

(58) Field of Search ..... 345/89, 204; 348/677, 348/674, 676; 341/150, 155

(56) References Cited

U.S. PATENT DOCUMENTS 4,558,363 A * 12/1985 Sugimoto ..... 348/676
5,877,717 A * 3/1999 Tu et al. ..... 341/150
5,940,058 A * 8/1999 Koyama ..... 345/89
5,990,979 A * 11/1999 Koyama et al. ..... 348/674
6,255,978 B1 * 7/2001 Chang et al. ..... 341/155

* cited by examiner

*Primary Examiner*—Steven Saras
*Assistant Examiner*—Fritz Alphonse
(74) *Attorney, Agent, or Firm*—Troxell Law Office PLLC

(57) ABSTRACT

A central symmetric Gamma voltage correction circuit is mainly applied to the displaying circuit of liquid-crystal display. By installing a resistor voltage dividing circuit and a driving circuit so that a well adjustment way to the Gamma correction voltage can be acquired. Moreover, the value of the Gamma correction voltage is controlled by externally inputting voltage, and thus the number of external correction reference voltage input externally and the number of the amplifiers are reduced. The resistor voltage dividing circuit and driving circuit are formed by a plurality of resistors, adjustable resistors and amplifiers so as to achieve the object of reducing the number of externally inputting correction voltages and the number of amplifiers.

13 Claims, 5 Drawing Sheets

CENTRAL SYMMETRIC GAMMA VOLTAGE CORRECTION CIRCUIT

FIELD OF THE INVENTION

The present invention relates to a central symmetric Gamma voltage correction circuit, which is mainly used to the displaying circuit of a liquid-crystal display. A circuit formed by a plurality of resistors, varistors and amplifiers. This, the number of the correction voltages input externally is reduced, and amplifier required can also be reduced.

BACKGROUND OF THE INVENTION

A Gamma voltage correction circuit is used to an active matrix liquid-crystal display. The main function thereof is to provide a digital coded signal converter. With respect the characteristic curve of a liquid-crystal display, the input image data is adjusted properly along a curve way. Through this conversion characteristic curve, the hue, gray level, contrast and color of the display can be adjusted.

With reference to FIGS. 1A to 1D, wherein FIG. 1A shows the relation of image data codes to the displaying property (T) of a liquid-crystal display, where T can be transmittance, hue, gray level, contrast, or color, etc. FIG. 1B shows the relation of the voltages in a general liquid-crystal display to the displaying property (T) of a liquid crystal display. FIG. 1C is a characteristic curve of image codes of liquid-crystal display relative to FIG. 1A. If it is desired to acquire the characteristic curve of FIG. 1C, an adjusting mechanism is necessary for compensating the change of the property of the display due to outer data to be input into the display. The adjusting mechanism is Gamma correction voltage. FIG. 1D shows a conversion curve of the data codes of Gamma voltage correction circuit relative to the voltages. In a TN(Twisted-Nematic) LCD, the characteristic curve of the transmittance of the liquid-crystal material to the voltage is a nonlinear curve. Therefore, in Gamma voltage circuit, the more the sampling points of the reference voltage, the smaller the approaching error of the characteristic curve can be obtained. In the trend of high resolution, for example, an 8-bit data driver for providing 256 gray levels, if it is desired to give an optimum adjustment to these 256 gray levels, the adjusting work is made through 256 reference voltage points which is provided externally. Furthermore, the adjusting work is performed one by one. However, the driving voltage of liquid-crystal material must be alternative voltage, and therefore, each of the positive and negative polarities needs 256 reference voltages. Totally, 512 external input reference voltages are necessary for adjustment, but it is impractical to make so many inputs of the reference voltage in one driving IC. In fact, it is seldom to make such a work. Therefore, in general, only a few reference voltages are provided externally, and then in the driving IC, by a voltage dividing way with a fixing ratio, the desired reference voltages without being provided externally are acquired by voltage dividing. However, these reference voltages from the resistor voltage dividing circuit must be confined by the externally provided reference voltages and the voltage dividing resistances. Further, the characteristic curve of the liquid-crystal display will be confined, namely, a larger error occurs as to approach the characteristic curve.

With reference to FIG. 2, a Gamma correction voltage with a fixed ratio resistor voltage dividing is illustrated. As shown in FIG. 2, in the driving of the general DC Gamma voltage, the data driver 3 generally needs a set of central symmetric Gamma correction voltage input. This central voltage is obtained from $V_{com}=(Vcc+V_{GND})/2$. The input voltage (Vcc, $V_{GND}$) passes through a resistor voltage dividing circuit 1 for voltage dividing so as to obtain a plurality of voltage dividing points. Then these points are transferred to the driving circuit 2 for gain-amplifying and then is transferred to a data driver 3 for identifying the correction voltages for driving the positive and negative polarities. FIG. 2 shows a way of voltage dividing by serial resistors to adjust a plurality of output voltage points. In this circuit, it is hard to properly adjust the levels of the voltages and to adjust the center voltages of the positive and negative polarities to be symmetric. Therefore, in this circuit structure, if any resistance is changed, other output voltages will be changed.

With reference to FIG. 3, a characteristic curve for the photoelectric effect for the voltage driving of general liquid-crystal displays. The relation of the driving voltage with respect to the displaying property of the display is illustrated. The $V_{com}$, defined as common voltage, in the drawing is a center voltage of the characteristic curve. The value of the central voltage is determined from an external voltage. The characteristic curve is symmetric at two sides of the central voltage, and a positive polarity region and a negative polarity region are classified at two sides of the central voltage. These positive polarity region and negative polarity region are the sources of the positive polarity voltage and negative polarity voltage required by the liquid-crystal display.

SUMMARY OF THE INVENTION

Accordingly, the primary object of the present invention is to provide a central symmetric Gamma voltage correction circuit, by the present invention, the displaying property of liquid-crystal display may be improved.

Another object of the present invention is to provide a central symmetric Gamma voltage correction circuit, wherein a well adjustment way to the Gamma correction voltage can be acquired.

A further object of the present invention is to provide a central symmetric Gamma voltage correction circuit, wherein the Gamma correction voltage can be controlled by externally inputting voltage so as to realize a simpler and flexible control way.

Yet, an object of the present invention is to provide a central symmetric Gamma voltage correction circuit, wherein by reducing the number of the Gamma voltage circuit, the number of the components in the circuit is also reduced.

A still object of the present invention is to provide a central symmetric Gamma voltage correction circuit, wherein by reducing the number of the externally input correction voltage in the Gamma coefficient circuit, the number of pins for inputting data to the Gamma correction voltage can be reduced.

In order to achieve the aforesaid object, the present invention provides a central symmetric Gamma voltage correction circuit for improving the defects in the prior art. In a basic circuit, by a circuit formed by resistors, adjustable resistors and amplifiers, a voltage is externally input and the voltage is divided by the resistors, varistors and amplifiers. After the varistors are adjusted, two ends of the varistors will acquire a positive polarity voltage and a negative polarity voltage.

In a preferred embodiment that the present invention is connected to a data driver, if the number of the input correction voltages required by the data driver is 2N, then through the preferred design of the present invention, a half of the coefficients are remained to be connected to the data driver by the OP buffer of the driving circuit, while another half are output by the two ends of the varistors of the Gamma voltage correction circuit without needing to be connected to the OP buffer.

Through the design of the present invention, the number of the externally inputting Gamma correction voltages is reduced to a minimum value, while for the correction voltages not being input externally can be acquired by a voltage dividing circuit and varistors.

The various objects and advantages of the present invention will be more readily understood from the following detailed description when read in conjunction with the appended drawing.

DETAILED DESCRIPTION OF THE PREFERRED EMBODIMENTS

In the present invention, a central symmetric Gamma voltage correction circuit is disclosed. By the present invention, the displaying property of a liquid-crystal display may be improved and a well adjustment way to the Gamma correction voltage can be acquired. By a resistor voltage dividing circuit and amplifiers (or buffers), the number of external input correction reference voltages and the number of the amplifiers are reduced. Furthermore, the level of a correction voltage can be adjusted by externally input voltage.

In the central symmetric Gamma voltage correction circuit of the present invention, a plurality of reference voltage is output. The output of the circuit is connected to a data driver. The data driver serves to convert the accepted voltage signal into more voltage signals. The number of the voltage signals will affect the displaying property of liquid-crystal display.

Figure 4:
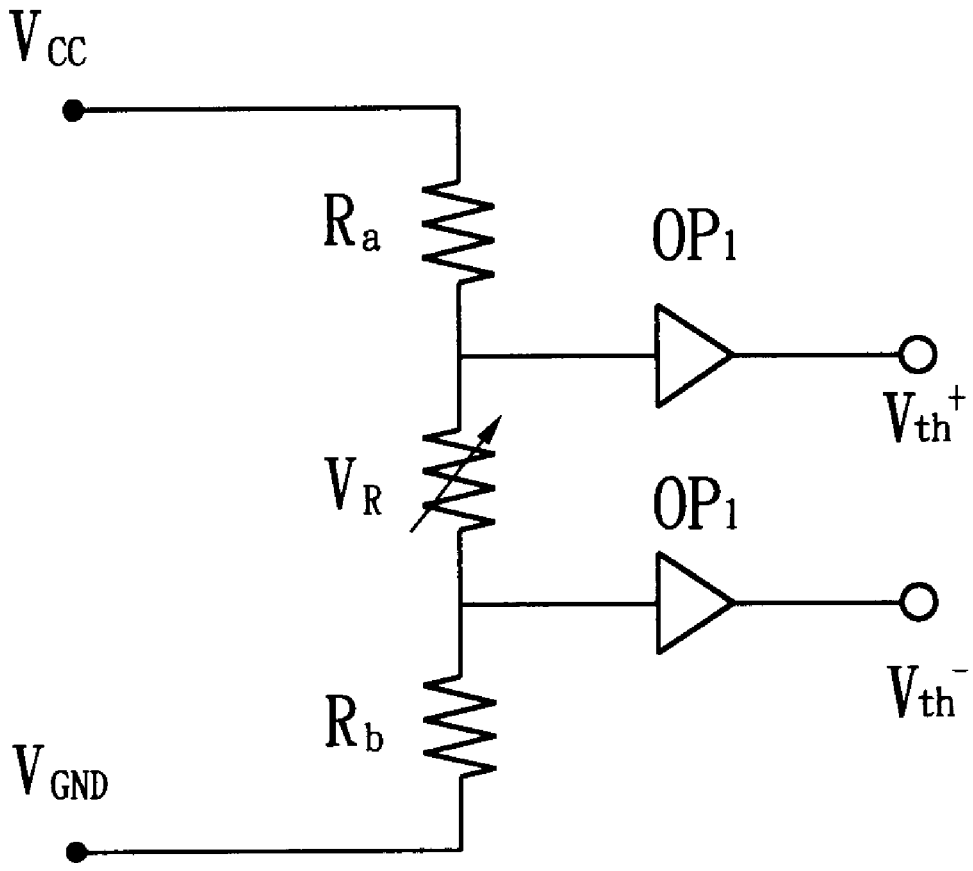
FIG. 4 shows a basic circuit of a preferred embodiment of the present invention.

Referring to FIG. 4, the circuit of a preferred embodiment of the present invention is illustrated. With reference to FIG. 4, the circuit is formed by two resistors, one varistor and two buffers. In this embodiment, the buffer may be assembled by operational amplifier. When a voltage Vcc is input externally, the voltage is divided by resistors Ra and Rb, and a varistor VR. When the resistance of the resistors Ra and Rb are equal, by adjusting the resistance of the varistor VR, output voltages can be acquired from two ends of the varistor VR, and then the outputs are individually connected to two different amplifiers $OP_1$, two different voltages are acquired. By the adjustment of the varistor VR, the voltages acquired from two ends of the varistor VR will provide a set of driving voltages of the positive and negative polarities, for example a positive polarity correction voltage ($Vth^+$) and a negative polarity correction voltage ($Vth^-$), to a data driver (not shown) at the succeeding circuit. The feature of the present invention is that by the adjustment of the varistors, the Gamma correction voltage is formed as a central symmetric voltage mode so that the positive and negative polarity curves are generated and symmetric central voltage generates a well symmetry.

Figures 1A, 1B, 1C, 1D:
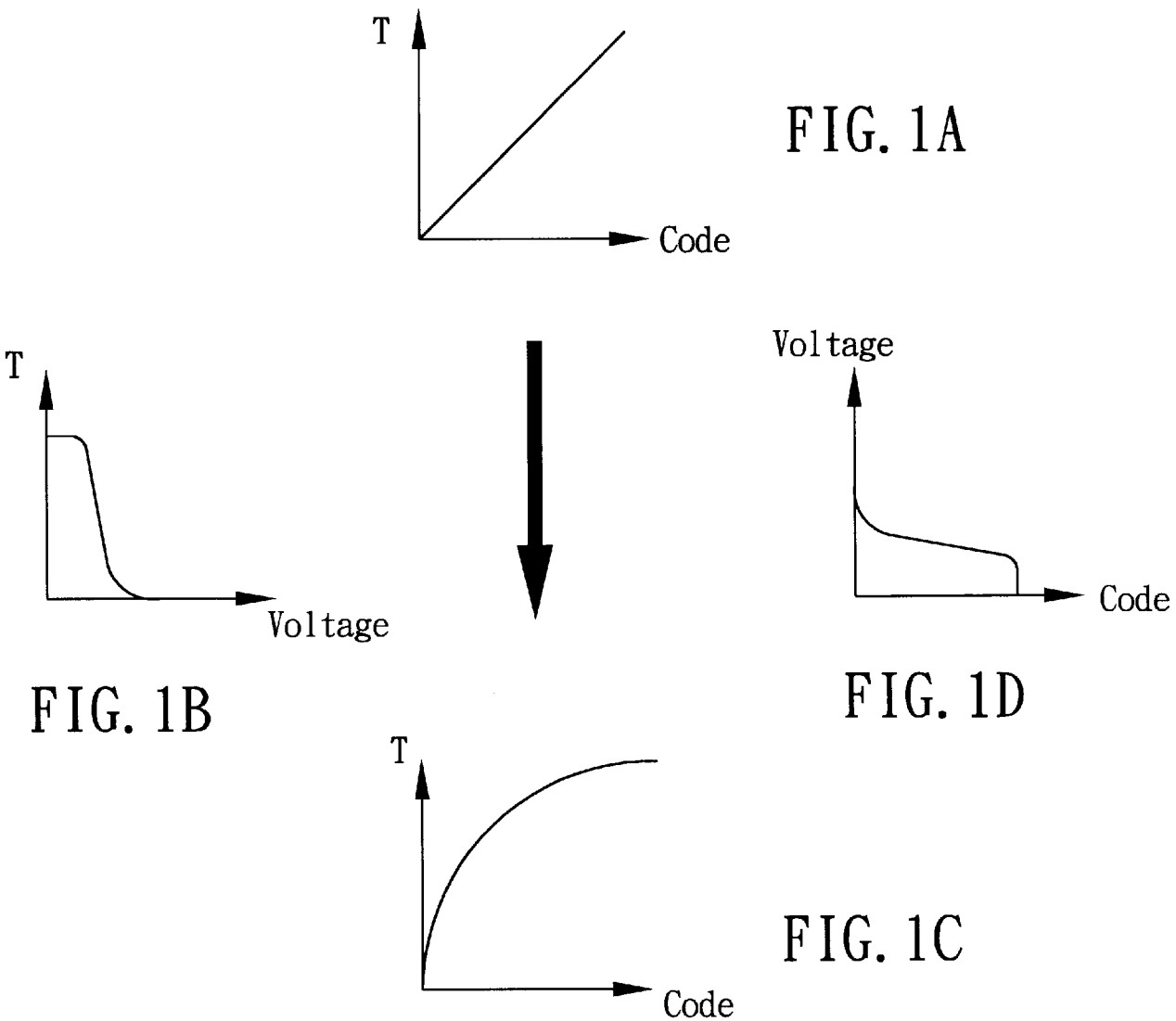
FIG. 1A shows the relation of image data codes to the displaying property (T) of a liquid-crystal display.
FIG. 1B shows the relation of the voltages in a general liquid-crystal display to the displaying property (T) of a liquid crystal display.
FIG. 1C is a characteristic curve of image codes of a liquid-crystal display to the displaying property (T) of a liquid crystal display.
FIG. 1D shows a conversion curve of the data codes of a Gamma voltage correction circuit to the voltages.
Figure 2:
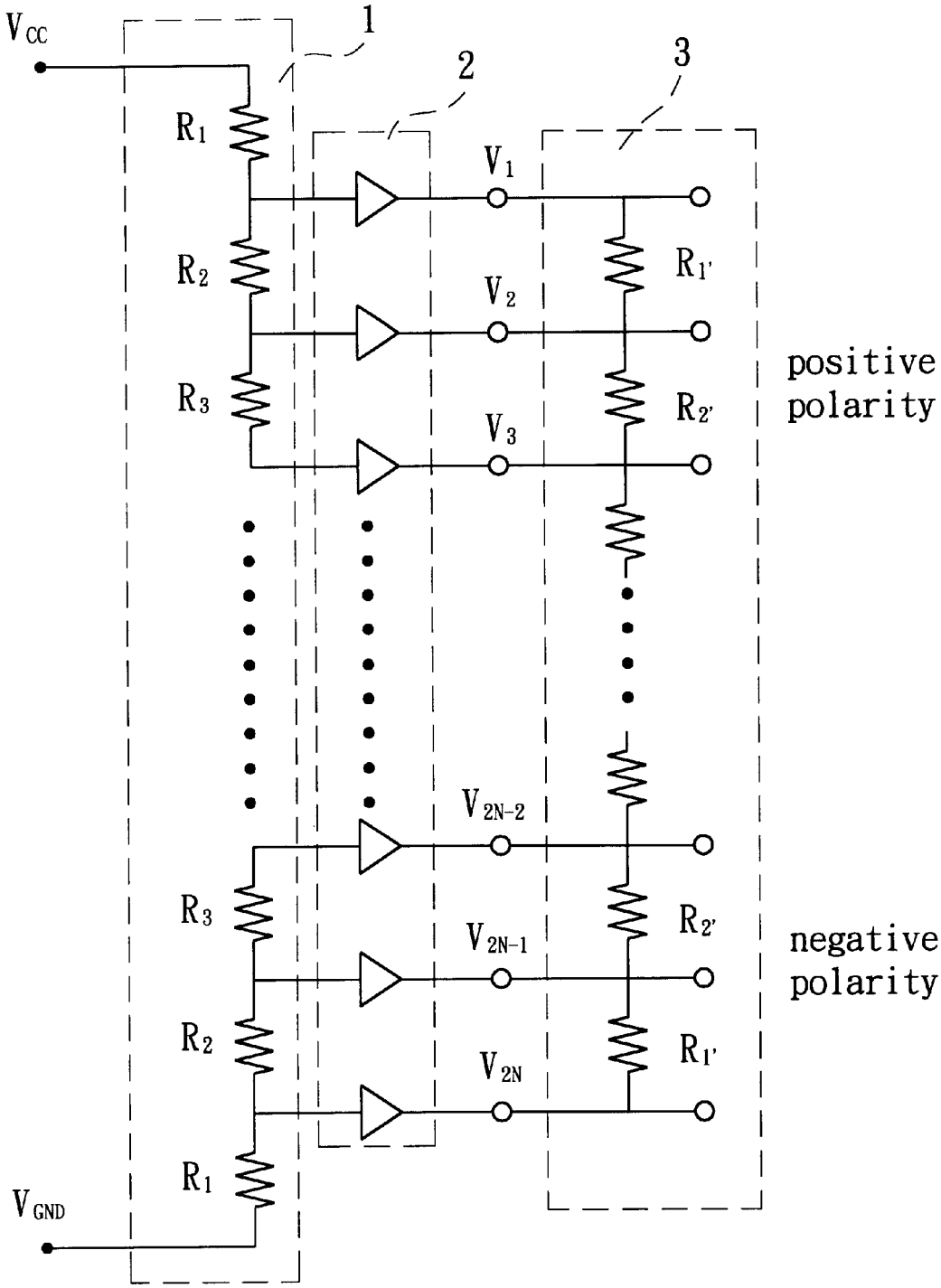
FIG. 2 shows a Gamma correction circuit with a fixed ratio resistor voltage dividing of prior art.
Figure 3:
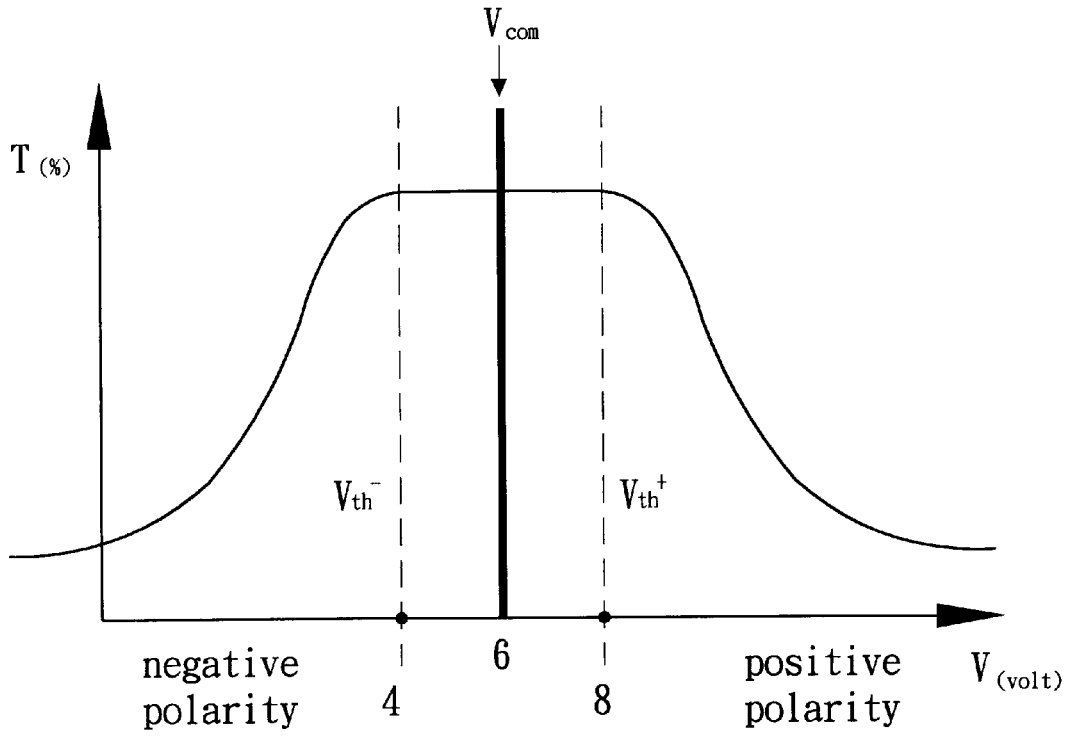
FIG. 3 shows the characteristics of the photoelectric effect of the driving of the voltages of a liquid-crystal display.

Referring to FIGS. 3 and 4, for example, when the input voltage is 12V ($VCC+V_{GND}=12V$), both Ra and Rb are 400Ω and the range of VR is 0~1kΩ, then the value of VR is adjusted to 400Ω so that a negative polarity voltage of 4V and a positive polarity voltage of 8V are acquired. The medium value between is a central voltage of $V_{com}$ $(Vcc+V_{GND})/2=6V$.

Of course, in realizing the present invention, the construction of the whole display circuit must be taken into consideration, the input voltage, resistances, and adjustable resistances may be adjusted properly for acquiring a preferred result.

Figure 5:
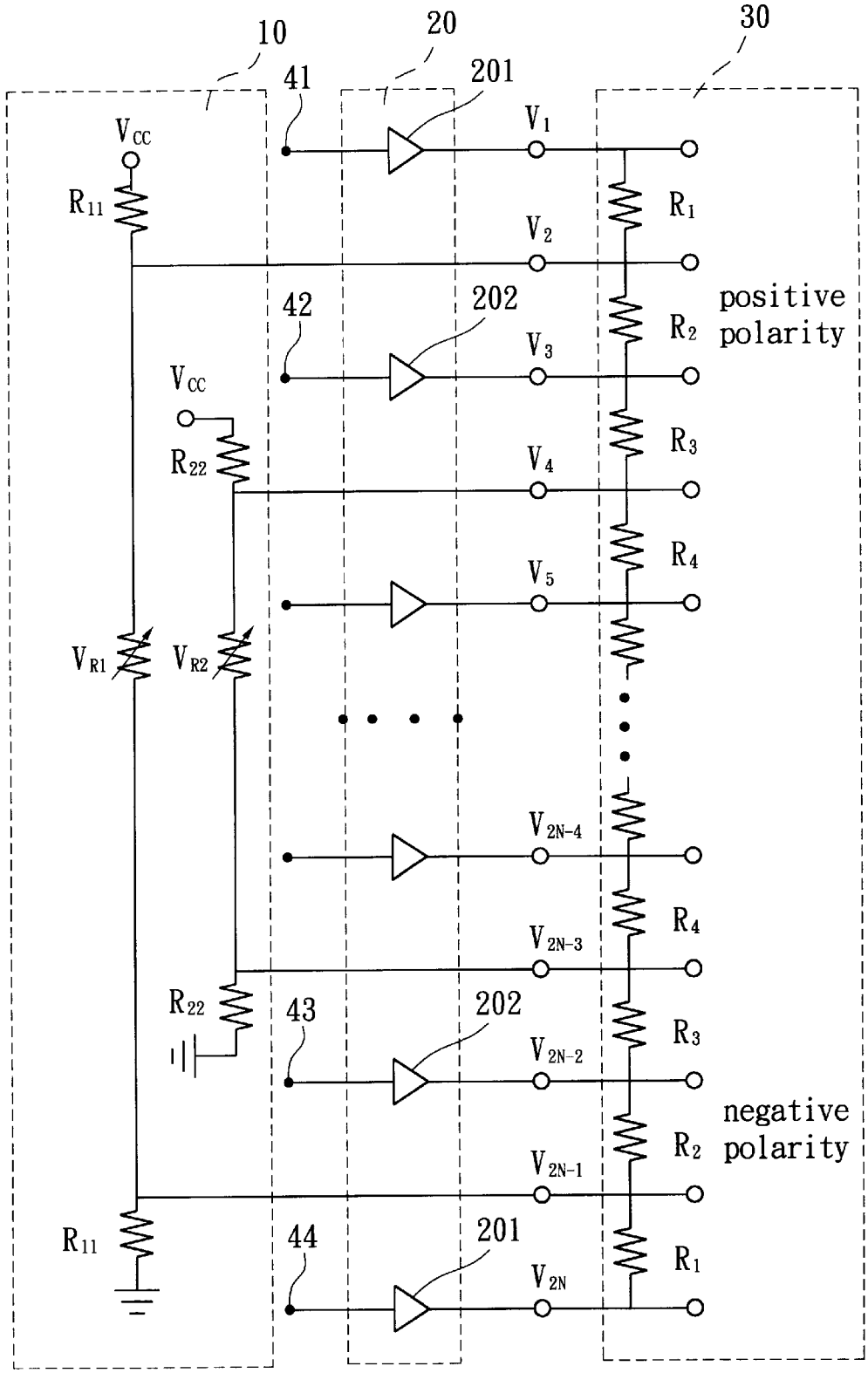
FIG. 5 shows a circuit diagram of a preferred embodiment showing that the present invention is connected to a data driver.

Referring to FIG. 5, a preferred embodiment showing that the present invention is connected to a data driver is illustrated. With reference to FIG. 5, the voltage dividing circuit 10 and the driving circuit 20 of FIG. 5 is an application of the circuit assembly of FIG. 4. For example, the resistors Ra and Rb and varistor VR are a voltage dividing sub-circuit formed by two resistors $R_{11}$, and $VR_1$. Two operational amplifiers $OP_1$ in FIG. 4 are two buffers 201 in the driving circuit 20 (in practical circuit design, it can be formed by amplifiers). The inputs 41, 44 of the two buffers 201 are correction reference voltage input externally. According to this model, the designing models of the second voltage dividing sub-circuit formed by $R_{22}$ and $VR_2$, the two buffers 202 of the driving circuits 30, and the input ends 42, 43 are identical to those described above. Each voltage dividing sub-circuit has the same input voltage, for example, Vcc. Therefore, it is unnecessary to input many externally reference voltages. The number of the externally input reference voltages can be a half. Furthermore, according to this way, the circuits illustrated in FIG. 4 can be applied to the voltage dividing circuit 10 and driving circuit 20 of FIG. 5.

Moreover, in FIG. 5, if the number of the input correction voltages required by the data driver 30 is 2N ($V_1$, $V_2$, . . . $V_N$, . . . $V_{2N-1}$, $V_{2N}$), through the design of this preferred embodiment, one half of the buffers in the driving circuit 20 (for example, buffers connected to V1, V3, V5, . . . $V_{2N-1}$) are connected to the driving circuit 30. The other $V_2$, $V_4$, $V_6$, . . . $V_{2N-2}$, $V_{2N}$ are voltage-divided by the resistors $R_{11}$, $R_{22}$, . . . , in the voltage dividing sub-circuits of the voltage dividing circuit 10 and the varistors $VR_1$, $VR_2$, . . . Then, by the adjusting model of the central symmetric voltage in the present invention, each voltage dividing sub-circuit may receive a common external reference voltage (for example Vcc). Then, with various resistors (for example, $R_{11}$, $R_{22}$, . . . ) serve to adjust the adjustable resistors $VR_1$, $VR_2$, . . . so that two ends of the adjustable resistors $VR_1$, $VR_2$, . . . are output with a set of positive and negative polarity voltage, respectively, and then they are connected to the data driver 30 without further needing to the buffers and then the data driver 30. Through the design of the present invention, the number of the Gamma correction voltages required in inputting data from external devices can be reduced to a minimum, while the correction voltages not input externally may be acquired from the voltage dividing circuit and adjustable resistors. In the case of a common used data driver, if 16 Gamma correction voltages are acquired for inputting positive and negative polarities, then after realizing the present invention, it is only needed to input externally four sets of Gamma correction voltages (each set includes a pair of one positive and one negative polarity voltages. This four sets of Gamma correction voltages can deduce 8 voltages of positive and negative polarities and then they are connected to 8 buffers and then to the data driver, while another four sets of Gamma correction voltages, through adjusting adjustable resistors, 8 different voltages with positive and negative polarities are obtained. They are connected directly to the data driver. This way may effectively reduce the number of the input correction voltages.

From above description about the present invention, in the present invention, the resistor voltage dividing circuit has a central symmetric voltage so that the Gamma correction voltage has an effective and well adjusting model. Furthermore, the Gamma correction voltage can be controlled by externally inputting voltage so as to realize a simpler and flexible control way. Moreover, the number of the buffers in the circuit and the number of pins for externally inputting the Gamma correction voltages are reduced.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A central symmetric Gamma voltage correction circuit comprising:

a driving circuit with one of the following two pluralities: plural amplifiers and plural buffers; having a plurality of buffers, the driving circuit receiving externally and processing a plurality of reference voltages and the processing results thereof being connected to an external data driver, the data driver serving to receive an output of a Gamma voltage correction voltage and then converting the output into a plurality of voltage sets; and characteristic in that: the Gamma voltage correction circuit further comprises a voltage dividing circuit; the a voltage dividing circuit having a plurality of voltage dividing sub-circuits, each voltage dividing sub-circuit having a plurality of resistor elements, the plurality of resistor elements having at least one adjustable resistor element wherein by adjusting the adjustable resistor element, two ends thereof are output with a respective output, and the acquired output result is connected to an input of the data driver, wherein if the number of input ends of the data driver is 2N, then the number of outputs of the driver circuit is N, and the number of outputs of the voltage dividing circuit is N.

2. The central symmetric Gamma voltage correction circuit as claimed in claim 1, wherein voltages from two ends of the adjustable resistor element are adjusted by the adjustable resistor element so that the voltage values of the two ends are formed as a central symmetric voltage adjusting model with respect to a middle value of the voltages.

3. The central symmetric Gamma voltage correction circuit as claimed in claim 1, wherein voltages from two ends of the adjustable resistor element are a pair of voltages of positive and negative polarities acquired by the data driver.

4. The central symmetric of Gamma voltage correction circuit as claimed in claim 1, wherein the plurality of buffers in the driving circuit comprises amplifiers.

5. A central symmetric Gamma voltage correction circuit comprising:

a driving circuit with one of the following two pluralities: plural amplifiers and plural buffers; having a plurality of the driving circuit receiving externally and processing a plurality of reference voltages and processed results being output; and a voltage dividing circuit having a plurality of voltage dividing sub-circuits, each voltage dividing sub-circuit having a plurality of resistor elements, the plurality of resistor elements having at least one adjusting the adjustable resistor element two ends thereof are output with a respective output, wherein outputs of the driving circuit and outputs of the voltage dividing circuit area s plural inputs of an external data driver the data driver, the data driver receives outputs of a Gamma voltage correction voltage, then converts receiving data into a plurality of voltages and then outputs them, if the number of input ends of the data driver is 2N, then the number of outputs of the driver circuit is N, and the number of outputs of the voltage dividing circuit is N.

6. The central symmetric Gamma voltage correction circuit as claimed in claim 5, wherein voltages from two ends of the adjustable resistor element are adjusted by the adjustable resistor element so that the voltage values of the two ends are formed as a central symmetric voltage adjusting model with respect to a middle value of the voltages.

7. The central symmetric Gamma voltage correction circuit as claimed in claim 5, wherein voltages from two ends of the adjustable resistor element are a pair of voltages of positive and negative polarities acquired by the data driver.

8. The central symmetric Gamma voltage correction circuit as claimed in claim 5, wherein the plurality of buffers in the driving circuit comprises amplifiers.

9. A central symmetric Gamma voltage correction circuit for reducing the number of external input correction reference voltages and the number of the buffers, comprising:

a driving circuit having a plurality of buffers, the driving circuit receiving externally and processing a plurality of reference voltages and the processing results thereof being connected to an external data driver, the data driver serving to receive an output of a Gamma voltage correction voltage and then converting the output into a plurality of voltage sets; and a voltage dividing circuit having a plurality of voltage dividing sub-circuits, each voltage dividing sub-circuit having a plurality of resistor elements, the plurality of resistor elements having at least one adjustable resistor element, and wherein by adjusting the adjustable resistor element two ends thereof are output with a respective output.

10. The central symmetric Gamma voltage correction circuit as claimed in claim 9, wherein voltages from two ends of the adjustable resistor element are adjusted by the adjustable resistor element so that the voltage values of the two ends are formed as a central symmetric voltage adjusting model with respect to a middle value of the voltages.

11. The central symmetric Gamma voltage correction circuit as claimed in claim 9, wherein voltages from two ends of the adjustable resistor element are a pair of voltages of positive and negative polarities acquired by the data driver.

12. The central symmetric Gamma voltage correction circuit as claimed in claim 9, wherein the plurality of buffers in the driving circuit comprises amplifiers.

13. The central symmetric Gamma voltage correction circuit as claimed in claim 9, wherein if the number of input ends of the data drive is 2N, then the number of outputs of the driver circuit is N, and the number of outputs of the data driver is N.

* * * * *